United States Patent [19]

Blackstone

[11] 4,069,893

[45] Jan. 24, 1978

[54] LADDER STABILIZER AND LEVELER

[76] Inventor: Charles David Blackstone, R.R. 2, Red Cloud, Nebr. 68970

[21] Appl. No.: 742,886

[22] Filed: Nov. 18, 1976

[51] Int. Cl.[2] ..... E06C 7/44

[52] U.S. Cl. ..... 182/200; 182/204

[58] Field of Search ..... 182/200, 201, 202, 203, 182/204, 107, 108

[56] References Cited

U.S. PATENT DOCUMENTS

| | | | |
|---|---|---|---|
| 1,393,536 | 10/1921 | Hunt | 182/203 |
| 3,937,298 | 2/1976 | Hurwitz | 182/200 |

FOREIGN PATENT DOCUMENTS

| | | | |
|---|---|---|---|
| 307,488 | 8/1955 | Switzerland | 182/200 |

*Primary Examiner*—Reinaldo P. Machado
*Attorney, Agent, or Firm*—Laurence R. Letson

[57] ABSTRACT

A ladder stabilizing support which is easily attachable to a ladder leg and provides two points of support on the ground or other supporting surface is disclosed. The support is provided with adjustable legs to accommodate uneven ground or other surface thereby improving stability on uneven surface. The support is fabricated in a truncated "A" shape and provides twisting resistance.

6 Claims, 5 Drawing Figures

LADDER STABILIZER AND LEVELER

BACKGROUND OF THE INVENTION

Ladders commercially available today seldom have leveling or extension legs as a part thereof. Devices to extend the legs of ladders are well known and range from primitive approaches of placing blocks or rocks under the ladder leg to permanently attached extension members such as illustrated in U.S. Pat. No. 2,318,017.

Generally when a member such as a ladder leg is extended, the ladder leg is inherently weakened due to its increased lever arm or due to the technique of attachment and its concentration of forces in a localized region which cause a bending movement on the leg.

Further with the extension members of the prior art, the ladder still does not have additional tendency to overcome twisting which is a major form of instability. The two support points are also displaced from a line parallel to the wall or other structure against which the ladder is leaning. This displacement poses a potential hazard particularly on surfaces sloping down and away from the structure supporting the upper end of the ladder. On such surfaces, the forces are such that a twisting and sliding force is generated.

Additional hazards are present when a single foot or support point extension is used since in many instances the down slope footing or support is not as stable as the up slope footing and this may create a tipping force mismatch.

SUMMARY OF THE INVENTION

The short comings of the prior art may be overcome and improvements realized by the implementation of the invention described herein. A frame member having a pair of independently adjustable legs is attached to one side or leg of a ladder in a plane generally perpendicular to the plane of the two legs of the ladder. The extendable leg members serve to provide stability both to keep the ladder from tilting laterally, but also to prevent the ladder from twisting about its longitudinal axis. The legs being independently extensible may accommodate uneven ground and provide increased contact area or may be used on planar surfaces such as stair step treads or floors.

OBJECTS OF THE INVENTION

It is therefore an object of the invention to extend the leg of a ladder in such a way as to accommodate uneven support surfaces.

It is an additional object of the invention to improve the lateral stability of the ladder to which it is attached.

It is another object of the invention to increase the surface area engaging the support surface.

It is a further object of the invention to increase the safety of the ladder when utilized on an uneven support surface.

These objects and others which will become apparent from the more detailed explanation and detailed description to follow are accomplished and the shortcomings and problems of the prior art devices are overcome by the ladder stabilizer described herein and in the accompanying drawings.

THE DRAWINGS

DETAILED DESCRIPTION OF THE INVENTION

Figure 1:
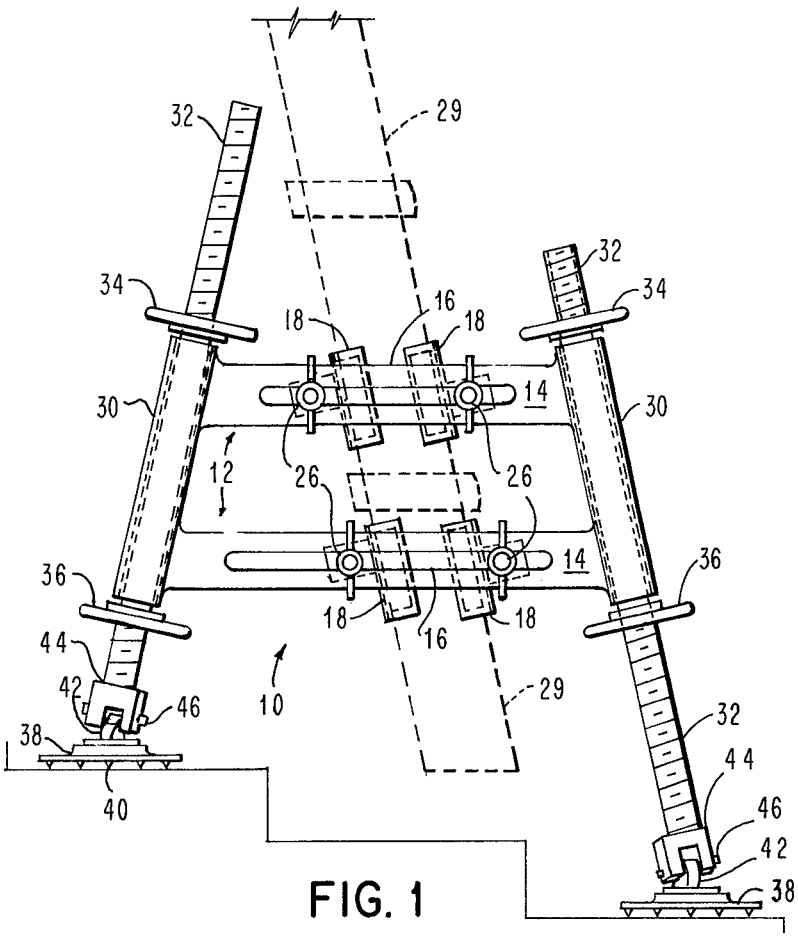
FIG. 1 is a side view of the ladder support member attached to a ladder leg.
Figure 3:
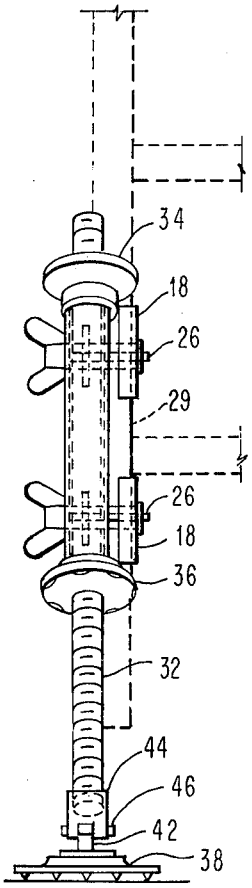
FIG. 3 is a front view of the support member.
Figure 4:
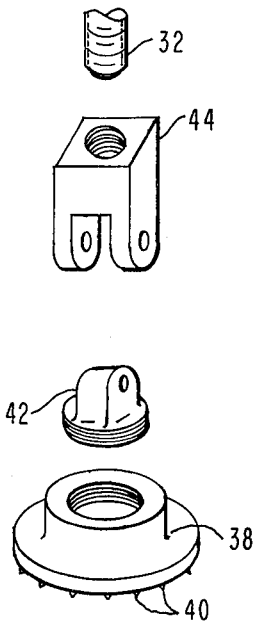
FIG. 4 is an exploded view of a swivel foot for the legs of the ladder support.

To provide support to a ladder, typically the extension type, a frame 10 is provided. The frame 10 may be fabricated in any desired manner to provide a horizontal clamping region 12. By way of example, a pair of horizontal members 14 are provided in generally parallel spaced relation. The members, in order to accommodate adjustments, are provided with slots 16 for the attachment of clamping or retaining members 18. The slots 16 allow lateral movement of the clamps 18 to accommodate ladders of varying width legs and ladders set at varying angles with the vertical. It is well recognized that although safety normally requires a ladder be positioned at an angle so that its base is approximately ¼ the length of the ladder from the wall or other object, this may not be possible at times.

Figure 2:
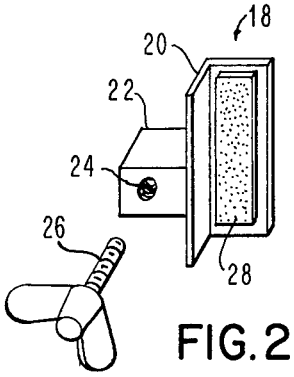
FIG. 2 is a front view of the clamp.
Figure 5:
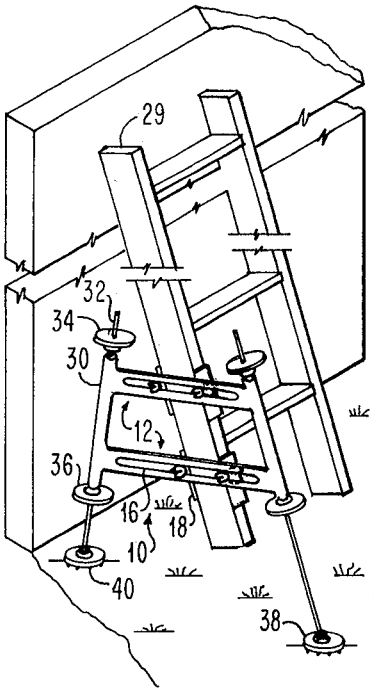
FIG. 5 is a perspective view of said ladder support illustrating its use on uneven terrain.

Clamps 18 are illustrated in FIG. 2 where an angle member 20 is permanently affixed to block 22 or nut member 22 having a female threaded portion 24. To attach such clamp member to the horizontal members 14 a threaded wing bolt 26 or similar screw threaded member is used. The slots 16 of support members 14 admit the wing bolt 26 and members 14 provide the surface against which the wing bolts 26 exert their clamping force.

The angle member 20 of clamp 18 may be provided with a non-slip surface 28, such as a rubber or similar material. The provision of such a non-slip surface insures a firm non-yielding engagement with the ladder leg 29. In addition, the clamps on at least one of the two support members 14 should also be engageable with the underside of a step on the ladder to provide additional vertical support in addition to the clamping forces.

One skilled in the art will recognize that alternative forms of attachment may be employed if desired, such as toggle clamps, chain clamps or a bar support retained at one or both ends by bolts or similar holding means. Such supports may be made to accommodate round rungs on ladders in addition to the flat rungs illustrated herein.

For the purposes of providing the support with force bearing members, hollow or tubular members 30 are either formed onto or attached to the horizontal support members 14. The interior of the tubular member 30 is a smooth bore large enough to accommodate a threaded rod like member or leg 32. The tubular member 30 provides restriction of movement of the rod member or leg 32 in two degrees of motion. The threaded leg 32 may slide through the tube 30.

To provide a means of holding the leg 32 axially with respect to the tube 30, locking and adjusting nuts or internally threaded hand wheels 34, 36 are provided. The hand wheels 34, 36 when tightened against the ends of tube 30 restrain legs 32 from coaxial movement through the tube 30.

Hand wheels 36 are weight bearing and under load bear against the bottom of the tube 30. To provide sufficient force bearing surface the wheel should have a flat area to engage the annular end surface of tube 30. An alternate arrangement may involve a second wheel adjacent the wheels 36 to be rotated up against wheels 36 to provide a locking effect. This will prevent inadvertant loosening of the wheel 36 with use.

In order to accommodate irregular surfaces, pivotal bases or feet 38 are provided. Such feet 38 may be of a variety of forms such as having cleats 40 or protrusions extending from the base 38. Alternative configurations could include surfaces covered with rubber or similar non-skid type material. Such material provides non-skid characteristics while at the same time preventing scarring and marring of smooth surfaces.

The feet 38 may be formed of threaded flanges for interchangeability and adopted to engage a threaded pivot member 42. To support the leg 32, second pivot member 44 may be threadly or permanently attached to the end of the leg 32 and a pivot pin or bolt 46 inserted through the pivot members 42, 44. Since pivot pin 46 allows only one degree of pivotal movement, pivot member 44 provides additional degrees of freedom through its ability to be turned with respect to legs 32, or to turn the legs 32 within hollow tubular members 30. By restricting the ability to pivot of the foot 38 to only one degree of movement, about the axis of pin 46, additional stability is developed and the possibility of inadvertant movement of foot 38 is reduced.

OPERATION OF THE INVENTION

To use the stabilizer, a ladder 29 is selected for use and positioned with respect to the object to be scaled. The frame of the stabilizer is placed against the down slope leg of the ladder 29 or at least one leg thereof and the bolts 26 loosened to allow lateral movement of clamps 18. The clamps 18 are positioned to trap the leg of ladder 29 between the clamp 18 and horizontal support member 14. The frame 10 is positioned to a substantially horizontal position and thus position tubes 30 approximately equiangularly with the horizontal. Bolts 26 are tightened to firmly attach the frame to the ladder 26. It is preferrable if one set of the clamps 18 either upper or lower be engaged with the underside of one of the steps of the ladder 26. This provides additional resistance to slipping of the ladder 26 through clamps 18.

After frame 10 is securely clamped to ladder 29 as set forth above, and the ladder 29 in position, retaining hand wheels 34 are loosened to permit leg 32 to slide through tube 30 to engage foot 38 with the ground or supporting surface. As foot 38 so engages the supporting surface, it may be necessary to rotate leg 32 or pivot member 44 to allow foot 38 to lie flat on the support surface.

When legs 32 are fully extended and properly positioned, weight bearing hand wheels 36 are turned to engage them with the lower force bearing ends of tubes 30. By tightening retaining hand wheels 34 or using a locking wheel or nut, wheels 36 when positioned against tube 30 cannot rotate. The ladder is now properly stabilized for use.

If additional stability or other factors dictate, a second such unit may be similarly engaged on the other side of the ladder 29. The use of two such units increases stability and reduces a turning and twisting tendency of a ladder on uneven surfaces. It also is apparent that there is a reduced tendency to slide on the part of the ladder since there is increased surface area to support the horizontal force components of force.

While certain modifications and changes have been suggested in the foregoing specification, others may become apparent to those skilled in the art and the rights claimed herein are not to be limited thereby, but only by the following claims.

I claim:

1. A detachable bipod attachment for attachment to one leg of a ladder for stabilizing a ladder comprising:
   - a rigid frame means;
   - a pair of extensible legs supporting said frame means, said legs individually extensible with respect to said frame and carrying thereon an adjustment and load bearing member;
   - pivotable foot means attached to one end of each of said extensible legs;
   - said pivotal foot means having non-slip surfaces on the support surface thereof;
   - means for rigidly attaching said frame means to one leg of a ladder in a plane substantially perpendicular to the plane of the legs of said ladder, thereby supporting said extensible legs to engage a surface upon which said ladder and said attachment will rest.

2. The ladder stabilizing attachment of claim 1 wherein said rigid frame means comprises a pair of support members and a pair of tubular members, said support members laterally spacing apart said tubular members to form a rigid frame said tubular members comprising a lower end thereof for load bearing engagement with said adjustment and load bearing member.

3. The ladder stabilizing attachment of claim 2 wherein said frame is trapazoidal in shape.

4. The ladder stabilizing attachment of claim 3 wherein said tubular members of said frame encompass said extensible legs.

5. The ladder stabilizing attachment of claim 1 wherein said means for attaching comprises a clamping means.

6. The ladder stabilizing attachment of claim 5 wherein said means for attaching comprise a load bearing member engageable with the underside of a step of said ladder.

* * * * *